US006725851B1

(12) United States Patent
Graf

(10) Patent No.: US 6,725,851 B1
(45) Date of Patent: Apr. 27, 2004

(54) ARROW REST FRAME WITH MULTIPLE SUPPORTS

(75) Inventor: Stephen Charles Graf, Pittsboro, NC (US)

(73) Assignee: Carolina Archery Products, Inc., Hillsborough, NC (US)

( * ) Notice: Subject to any disclaimer, the term of this patent is extended or adjusted under 35 U.S.C. 154(b) by 0 days.

(21) Appl. No.: 10/413,843

(22) Filed: Apr. 15, 2003

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 4,282,850 A 8/1981 Warnicke
4,351,311 A 9/1982 Phares
4,372,282 A 2/1983 Sanders
4,858,589 A 8/1989 Chang
4,917,072 A 4/1990 Chang
5,042,450 A 8/1991 Jacobson
5,253,633 A 10/1993 Sisko
5,456,242 A 10/1995 Ruholl
5,460,153 A 10/1995 Huntt
5,462,041 A * 10/1995 Solecki ..... 124/44.5
5,685,287 A 11/1997 Greywall
5,896,849 A 4/1999 Branthwaite et al.
5,960,779 A 10/1999 Jessee et al.

* cited by examiner

*Primary Examiner*—John A. Ricci
(74) *Attorney, Agent, or Firm*—Kilpatrick Stockton LLP

(57) ABSTRACT

Systems and methods for providing a frame of an arrow rest are disclosed. The arrow rest frame includes first projections and second projections. The frame includes a first surface and a second surface. The first projections, which include a first resistance extend from the second surface. The second projections, which include a second resistance extend from the second surface. The first resistance is greater than the second resistance. The first and second projections define an aperture, wherein an arrow may be radially supported.

25 Claims, 6 Drawing Sheets

ARROW REST FRAME WITH MULTIPLE SUPPORTS

NOTICE OF COPYRIGHT PROTECTION

A portion of the disclosure of this patent document and its figures contain material subject to copyright protection. The copyright owner has no objection to the facsimile reproduction by anyone of the patent document, but otherwise reserves all copyrights whatsoever.

FIELD OF THE INVENTION

The invention generally relates to archery equipment and, more particularly, to arrow rests.

BACKGROUND

Many arrow rests are known to support an arrow shaft prior to and after release. The most basic rest is a flat or angular surface. Rests attempt to minimize the amount of friction with the arrow to prevent damage to the arrow or fletching (e.g., feathers) and to increase the reliability of each shot. Minimizing the restraint of the arrow, however, can result in the arrow slipping from the rest when the bow is tilted or rotated radially or when drawing an arrow, which is often the case during hunting.

Some arrow rests attempt to provide radial support to the arrow shaft to prevent the arrow from slipping when tilting or rotating the bow. Most of these devices, however, impart severe frictional resistance to the passage of the arrow unless the fletching is oriented rather precisely to the radial openings in the arrow rest. Repeated use of these devices can likely result in fletching wear, which decreases the overall effective lifespan of an arrow. Other devices, such as that described in U.S. Pat. No. 5,896,849 address such problems. U.S. Pat. No. 5,896,849, assigned to the assignee of the present invention, is incorporated in its entirety herein by reference. However, even with these improvements, repeated use may result in some fletching wear.

Other devices attempt to reduce friction and wear to the fletching by providing gaps between supporting elements in the arrow rest. Generally, an arrow does not travel in a straight line when it contacts the supporting elements in such devices, and thus, the fletching can likely impact against the supporting elements. Repeated use of these devices can likely result in fletching wear.

Additionally, subjecting the vanes to uneven contact can cause the arrow to deflect when traveling through the rest. Thus, such devices tend to reduce the accuracy of an arrow shot. In one arrow rest, a slot is placed in the outer ring. In some of these devices, the sound of drawing the arrow through the rest can be readily noticeable by the human ear, and even more importantly, by the hearing of wild game.

SUMMARY OF THE INVENTION

The present invention comprises systems and methods for providing a frame of an arrow rest including multiple arrow supporting elements. Embodiments of the present invention may take a wide variety of forms. In one exemplary embodiment, an arrow rest frame includes a plurality of first projections and a plurality of second projections. The frame includes a first surface and a second surface. The plurality of first projections, which includes a first resistance, extends from the second surface. The plurality of second projections, which includes a second resistance, extends from the second surface. The first and second projections define an aperture in which an arrow may be radially supported. The first resistance is greater than the second resistance.

In one embodiment, the first projections include a first diameter and the second projections include a second diameter. The first resistance correlates with the first diameter and the second resistance correlates with the second diameter. In another embodiment, the first projections include a first density and the second projections include a second density. The first resistance correlates with the first density and the second resistance correlates with the second density.

In another exemplary embodiment, a system includes an archery bow, a base member coupled to the bow, and an arrow rest coupled to the base member. The arrow rest includes means for radially supporting an arrow relative to the bow. The supporting means includes a first projection and a second projection. The first projection includes a first resistance and the second projection includes a second resistance. The first resistance is greater than the second resistance.

In one embodiment, the first projections include a first diameter and the second projections include a second diameter. The first resistance correlates with the first diameter and the second resistance correlates with the second diameter. In another embodiment, the first projections include a first density and the second projections include a second density. The first resistance correlates with the first density and the second resistance correlates with the second density.

In a further exemplary embodiment, a method includes coupling a plurality of first projections and a plurality of second projections to a surface of a frame. The first and second projections extend from the surface of the frame. The first projections include a first resistance and the second projections include a second resistance. The first resistance is greater than the second resistance.

In one embodiment, the first projections include a first diameter and the second projections include a second diameter. The first resistance correlates with the first diameter and the second resistance correlates with the second diameter. In another embodiment, the first projections include a first density and the second projections include a second density. The first resistance correlates with the first density and the second resistance correlates with the second density.

An advantage of the present invention can be to reduce wear to an arrow fletching.

Another advantage of the present invention can be to reduce the noise resulting from drawing and releasing an arrow.

A further advantage of the present invention can be to reduce the frictional resistance imparted to an arrow during loading and release.

Yet another advantage of the present invention can be to provide support to an arrow prior to and during release of the arrow.

These exemplary embodiments are mentioned not to summarize the invention, but to provide an example of an embodiment of the invention to aid understanding. Exemplary embodiments are discussed in the Detailed Description, and further description of the invention is provided there. Advantages offered by the various embodiments of the present invention may be understood by examining this specification.

BRIEF DESCRIPTION OF THE DRAWINGS

The accompanying drawings, which constitute part of this specification, help to illustrate embodiments of the invention. In the drawings, like numerals are used to indicate like elements throughout.

DETAILED DESCRIPTION

Embodiments of the present invention include systems and methods for providing an arrow rest including multiple arrow supporting elements. The principles of the present invention described are applicable to both left and right-handed applications. U.S. patent application Ser. No. 10/342,751, filed on Jan. 15, 2003 and assigned to the assignee of the present invention, is incorporated in its entirety herein by reference.

Figure 1:
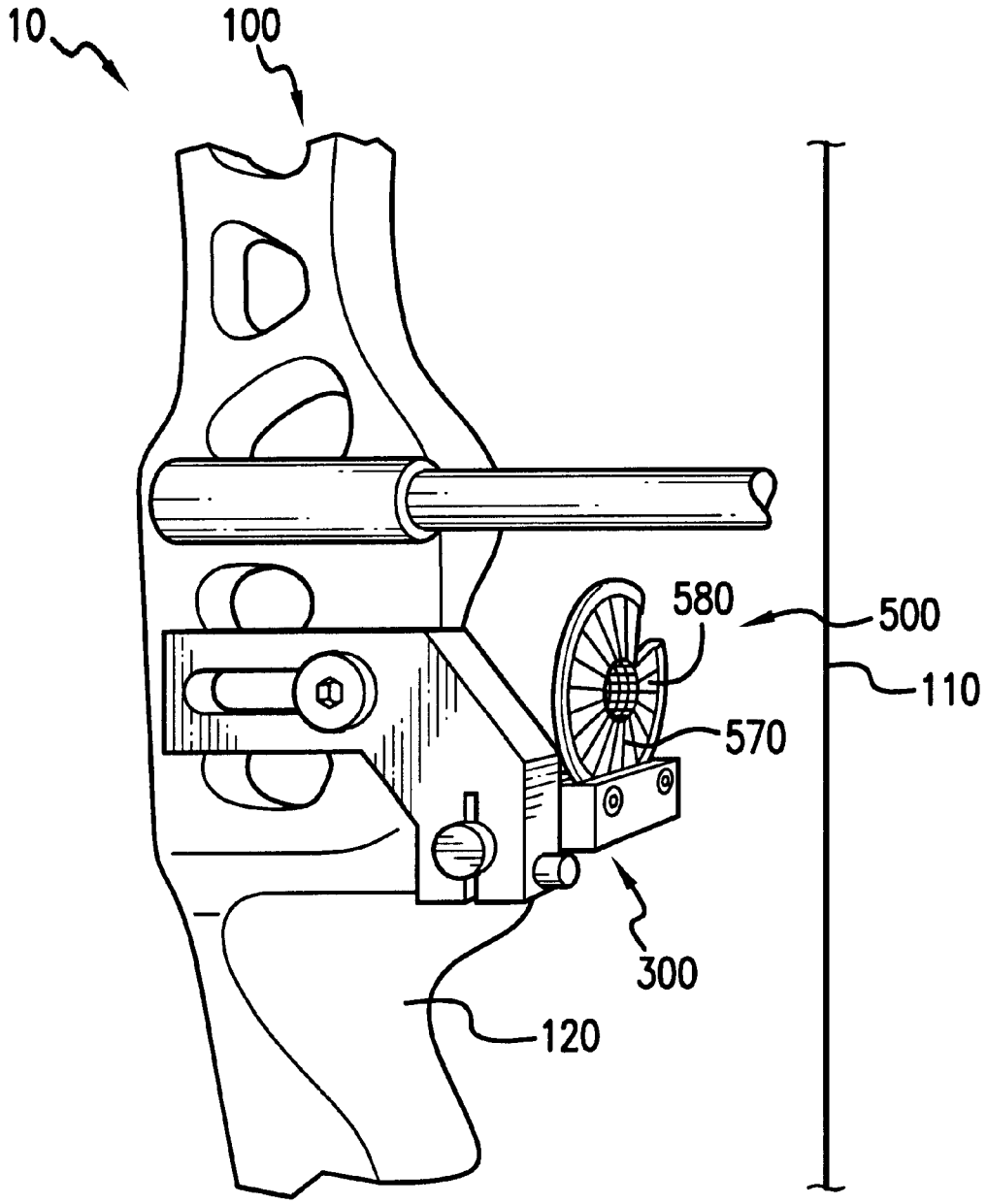
FIG. 1 is a cutaway perspective view of a system according to an embodiment of the present invention for a left-handed application.

FIG. 1 is a cutaway perspective view of a system 10 according to an embodiment of the present invention. The system 10 includes an archery bow 100, an arrow rest frame 500, and a base member 300. The system 10 shown is preferably used by a left-handed person, but other embodiments are used by right-handed persons.

A bow string 110 is disposed behind the arrow rest frame 500, which will be described in more detail below. The base member 300 is coupled with the bow 100 above a handle 120 of the bow 100. As will be described in more detail below, the frame 500 is coupled with and supported by the base member 300. Terms of position, such as "behind," "above," "front," etc., refer to positions with respect to one handling the bow 100 in a traditional manner.

Figure 2:
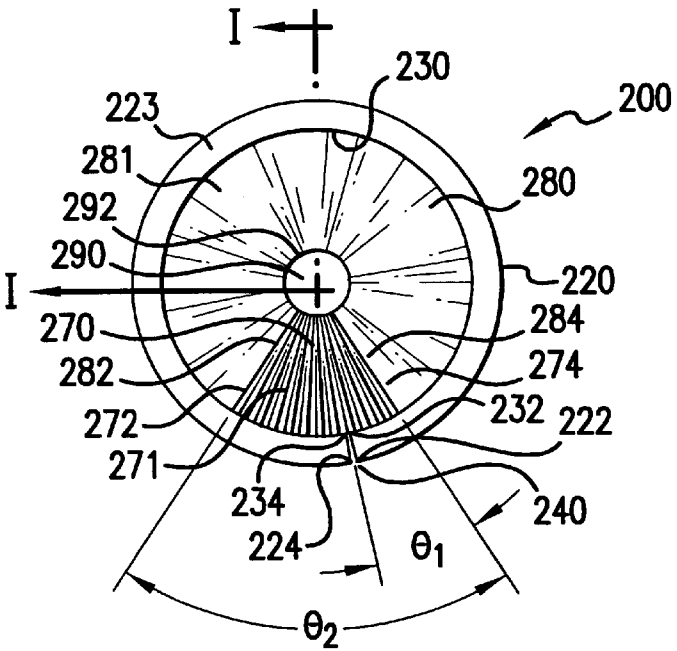
FIG. 2 is an elevation view of a frame of an arrow rest.
Figure 3:
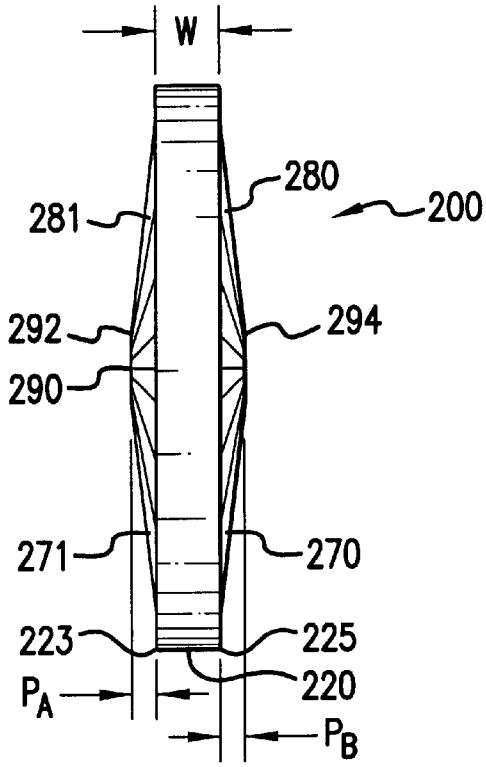
FIG. 3 is a side view of the arrow rest frame of FIG. 2.

FIG. 2 is an elevation view of a frame of an arrow rest 200. FIG. 3 is a side view of FIG. 2. Referring now to FIGS. 2–3, the frame 200 is shown, including a first surface 220 and a second surface 230. The first surface 220 forms an outer perimeter of the frame 200. Preferably, the frame 200 is substantially circular in shape. Alternatively, other suitable shapes can be used, for example, semi-circular, rectangular, triangular, or other polygonal shapes. In one embodiment, an outer diameter of the frame 200, i.e., measured to the first surface 220, is approximately two inches. Alternatively, other suitable dimensions can be used.

Preferably, the frame 200 is formed of galvanized carbon steel. Alternatively, the frame 200 is formed of other suitable materials, such as, for example, aluminum, stainless steel, plastics, or composite materials. Preferably, several frames 200 are formed from a metal coil and separated into separate frames 200. In one embodiment, the metal coil is approximately 0.375 inches wide and approximately 0.028 inches thick. Alternatively, the frame 200 can be formed using other suitable dimensions and by other suitable means, such as by machining or by a mold.

The first surface 220 of the frame 200 includes a first end 222 and a second end 224. The second surface 230 of the frame 200 includes a first end 232 and a second end 234. The first and second ends 222, 224 of the first surface 220 and first and second ends 232, 234 of the second surface 230 form a gap 240. The gap 240 is formed when separating several frames 200, as described above. As the frame 200 can generally be deformed by hand, the width of the gap 240 can be adjusted or manipulated as desired. Preferably, a width of the gap 240 is no greater than 0.050 inches. Alternatively, there is no observable gap 240 and the frame 200 is substantially continuous.

An angle $\theta_1$ defines the placement of the gap 240, and is measured from a second side 274 of the first projections 270 (described in more detail below). Preferably, the angle $\theta_1$ is in a range between approximately 5 degrees and approximately 20 degrees. In one embodiment, the angle $\theta_1$ is approximately 10 degrees. In another embodiment, the angle $\theta_1$ is approximately 17 degrees.

Coupled to the second surface 230 are first projections 270. Preferably, the first projections 270 are formed of a plurality of bristles. Alternatively, the first projections 270 are formed of a unitary supporting element. For example, the unitary supporting element can be a generally "pie-shaped" material of sufficient strength to support an arrow and of sufficient durability to withstand repeated deflections. The first projections 270 extend from the second surface 230. Preferably, the first projections 270 extend radially inward. Alternatively, the first projections 270 extend in other suitable directions or orientations.

The first projections 270 are substantially columnar in shape and have a generally uniform diameter along their entire length. Thus, a cross-section of each of the first projections 270 is preferably circular. Alternatively, other suitable cross sections can be used, such as, for example, triangular, square, or cross-shaped.

In one embodiment, the first projections 270 are tapered in which a diameter at an end proximate the second surface 230 is greater than a diameter at an opposite end of the projection 270. In another embodiment, a perimeter forming a profile of the first projection 270 is undulate shaped, i.e., sinuous, crimped, or wave-like. The first projections 270 also include a resistance.

The term "resistance" refers to the quality of opposing a force or external pressure. An element of a structure having high "resistance" is rigid or inflexible and exhibits little or no observable deflection when a force is applied to the element. An element having a low "resistance" is one which is pliable or elastic and exhibits noticeable deflection when the force is applied to it. Resistance can correlate with several measurable physical properties, such as material property, physical configuration of the element, and the arrangement or grouping of several elements.

The resistance of an element of a structure can correlate with a material property. Some materials by their very nature are inelastic, such as, for example, a steel rod or a concrete pillar, while others are elastic, such as a rubber hose. Thus, inelastic materials have a higher resistance than elastic materials. Resistance can also correlate with the physical configuration of the element.

For example, steel is considered generally inelastic, and thus, has a generally high resistance. However, if formed as a column having a small diameter and a large length, such as for example, an automobile antenna, this steel column could exhibit somewhat elastic properties and have a low resistance. Alternatively, a generally pliable material, such as rubber when formed with a large diameter and a short length, for example, as a rubber mallet, can be less pliable and have a high resistance. So, the metal automobile antenna can have a lower resistance than the rubber mallet even though steel is generally considered to be a generally inelastic material while rubber is considered to be a generally elastic material.

Resistance can also correlate with the grouping or physical arrangement of several structural members. For example, rubber bristles, either individually or loosely arranged, are generally considered elastic, and thus, have a lower resistance. However, the same rubber bristles when grouped tightly together, would exhibit a higher resistance to an applied force. The number of structural elements per unit area can be referred to as a density. Thus, a grouping of elements having a high density, or concentration, would exhibit a higher resistance than a grouping of the same elements arranged with a lower density.

In one embodiment, the resistance of the first projections 270 correlates with the diameter of the first projections 270. Preferably, the diameter of the first projections 270 is in a range between approximately 0.008 inches and approximately 0.012 inches. Most preferably, the diameter of the first projections 270 is approximately 0.010 inches. Other suitable diameters can be used.

Preferably, the bristles forming the first projections 270 are made of a synthetic polymer. In another embodiment, the bristles forming the first projections 270 include a layer or a coating of a polytetrafluoroethylene, also commonly known by its trade-name Teflon®. Alternatively, the first projections 270 can be formed of other suitable materials of sufficient strength and resiliency to withstand repeated deflection by an arrow being projected through the frame 200, including natural fibers, such as, for example, boar's hair.

In one embodiment, the first projections 270 include a first side 272 and a second side 274. The first projections 270 are bounded the first side 272 and the second side 274 forming a first supporting portion 271. An angle $\theta_2$ defines the first supporting portion, and preferably is in a range between approximately 55 degrees and approximately 75 degrees. In one embodiment, the angle $\theta_2$ is approximately 58 degrees. In another embodiment, the angle $\theta_2$ is approximately 70 degrees.

In one embodiment, the resistance of the first supporting portion 271 correlates with the density of the first supporting portion 271. Preferably, a density of the first supporting portion 271 is in a range between approximately 9000 projections per square inch and approximately 13,000 projections per square inch. Other suitable densities can be used.

Also coupled to the second surface 230 are second projections 280. Preferably, the second projections 280 are formed of a plurality of bristles. Alternatively, the second projections 280 are formed of a unitary support. The second projections 280 extend from the second surface 230. Preferably, the second projections 280 extend radially inward. Alternatively, the second projections 280 extend in other suitable directions or orientations.

The second projections 280 are substantially similar in size and shape to the first projections 270. Alternatively, the second projections 280 can be sized and shaped differently than the first projections 270. In one embodiment, for example, the second projections 280 can be tapered or undulate shaped, as described above, while the first projections 270 are columnar in shape. Preferably, the second projections are substantially columnar in shape and have a generally uniform diameter along their entire length.

In one embodiment a resistance of the second projections 280 correlates with the diameter of the second projections 280. Preferably, the diameter of the second projections 280 is in a range between approximately 0.004 inches and approximately 0.010 inches. Most preferably, the diameter of the second projections 280 is approximately 0.006 inches. Preferably, the diameter of the first projections 270 is greater than the diameter of the second projections 280. In one embodiment, the diameter of the first projections 270 is less than the diameter of the second projections 280. In another embodiment, the diameter of the first projections 270 is substantially equal to the diameter of the second projections 280.

Preferably, the bristles forming the second projections 280 are made of a synthetic polymer. In another embodiment, the bristles forming the second projections 280 include a layer or a coating of a polytetrafluoroethylene. Alternatively, the second projections 280 can be formed of other suitable materials of sufficient strength and resiliency to withstand repeated deflection by an arrow being projected through the frame 200, including natural fibers.

In one embodiment, the second projections 280 include a first side 282 and a second side 284. The second projections 280 are bounded by the first side 282 and the second side 284 forming a second supporting portion 281. Preferably, the first side 282 of the second projections 280 is disposed adjacent to the first side 272 of the first projections 270 and the second side 284 of the second projections 280 is disposed adjacent to the second side 274 of the first projections 270. In one embodiment, the second supporting portion 281 extends continuously around the second surface 230 from the first side 282 of the second projections 280 to the second side 284 of the second projections 280. Preferably, the first supporting portion 271 is colored differently than the second supporting portion 281 to aid an archer in readily distinguishing between the different supporting portions of the frame 200.

In one embodiment, the resistance of the second supporting portion 281 correlates with a density of the second supporting portion 281. Preferably, the density of the second supporting portion 281, is in a range between approximately 18,000 projections per square inch and approximately 26,000 projections per square inch. Also preferably, the total number of bristles in both the first and second supporting portions 271, 281 is approximately 20,000 bristles. Alternatively, other suitable densities of the second supporting portion 281 can be used. Preferably, the density of the second supporting portion 281 is greater than the density of the first supporting portion 271. In one embodiment, the density of the second supporting portion 281 is less than the density of the first supporting portion 271. In another embodiment, the density of the second supporting portion 281 is substantially equal to the density of the first supporting portion 271.

In one embodiment, the first supporting portion 271 is approximately equal in size to the second supporting portion 281. In another embodiment, there are an equal number of first and second supporting portions 271, 281, e.g., three first supporting portions 271 and three second supporting portions 281, all of approximately equal size. In this embodiment, the first supporting portions 271 and the second supporting portions 281 are arranged in an alternating pattern. For example, disposed adjacent to each side of each first supporting portion 271 is a second supporting portion 281. In yet another embodiment, the first projections 270 and the second projections 280 are intermixed together along the entire second surface 230.

As described above, the first projections 270 and the second projections 280 extend radially inward. The first projections and the second projections form an aperture 290. Preferably, the aperture 290 is substantially closed. The term "closed" refers to a perimeter formed by the aperture 290 that is generally continuous. Preferably there is no clearly visible opening in the perimeter of the aperture 290. In the configuration described here, an arrow shaft would not likely be able to escape the aperture 290 by ordinary movement or rotation of bow 100.

The aperture 290 is preferably a substantially circular shape. In one embodiment, a diameter of the aperture 290 is in a range between approximately 0.250 inches and approximately 0.040 inches. In one embodiment, the diameter of the aperture 290 is approximately 0.260 inches. In another embodiment, the diameter of the aperture 290 is approximately 0.320 inches. In yet another embodiment, the diameter of the aperture 290 is approximately 0.360 inches. The diameter of the aperture 290 is sized to accommodate a diameter of an arrow shaft. Other suitable dimensions for the diameter of the aperture 290 can be used. The aperture 290 and the frame 200 are concentric. Alternatively, the aperture can be formed of other suitable shapes and disposed in other suitable positions.

Referring now to FIG. 3, a side view of the frame 200 of FIG. 2 is shown. As shown in FIG. 3, a width W of the first surface 220 of the frame 200 is shown. Preferably, the width W is approximately 0.150 inches. Alternatively, other suitable dimensions can be used. First projections 270 and second projections 280 extend beyond the width W of the frame 200 on either side of the frame 200 forming first and second perimeters 292, 294 of the aperture 290. Thus, first and second projections 270, 280 form a gradual slope upward from the first and second sides 223, 225 of the first surface 220 toward the aperture 290.

Preferably, a distance $P_A$ from a first side 223 of the first surface 220 to the first perimeter 292 is approximately equal to a distance from $P_B$ from a second side 225 of the first surface 220 to the second perimeter 294. Alternatively, distances $P_A$ and $P_B$ can be different from each other. Preferably, the distances $P_A$ and $P_B$ are each in a range between approximately 0.000 inches to approximately 0.150 inches. Most preferably the distances $P_A$ and $P_B$ are each approximately 0.105 inches.

Figure 4:
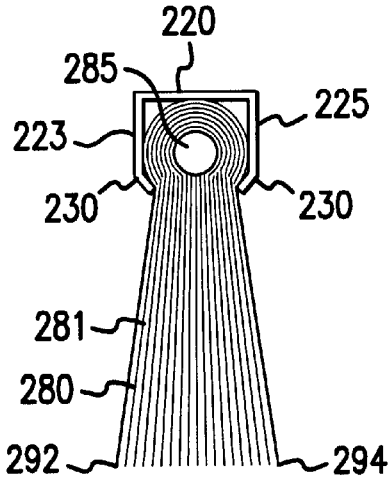
FIG. 4 is a cross-sectional view of the arrow rest frame of FIG. 2 along the line I—I.

Referring now to FIG. 4, a cross-section along line I—I in FIG. 2 is shown. As shown, second projections 280 are coupled to a shaft 285. Preferably, shaft 285 is a generally flexible wire or cable and is disposed in the frame 200. Preferably, shaft 285 is circular in cross-section and is of a generally uniform diameter. In one embodiment, shaft 285 is a copper coated steel wire approximately 0.048 inches in diameter. Alternatively, shaft 285 can be other suitable cross-sections, and can have several different diameters about its length.

Preferably, the second projections 280 are wrapped about shaft 285. Alternatively, second projections 280 can be fixedly attached to shaft 285. Other suitable means of coupling second projections 280 to shaft 285 can be used. First projections 270 are similarly coupled to shaft 285, and will not be described further.

First surface 220, first and second sides 223, 225, and second surface 230 form a channel in which the shaft 285 and first and second projections 270, 280 are disposed. In one embodiment, a cross-section of the channel is rectangular. Alternatively, other suitable shapes for the channel can be used, such as, for example, semicircular.

Preferably, shaft 285 and first and second projections 270, 280 are secured to frame 200 by crimping second surface 230 to the first and second projections 270, 280. Second surface 230 is preferably crimped with sufficient force to secure first and second projections 270, 280 in place with generally no noticeable displacement. Alternatively, other suitable means can be used to secure first and second projections 270, 280 and shaft 285 to the frame 200, such as, for example, by adhesion.

Figure 5:
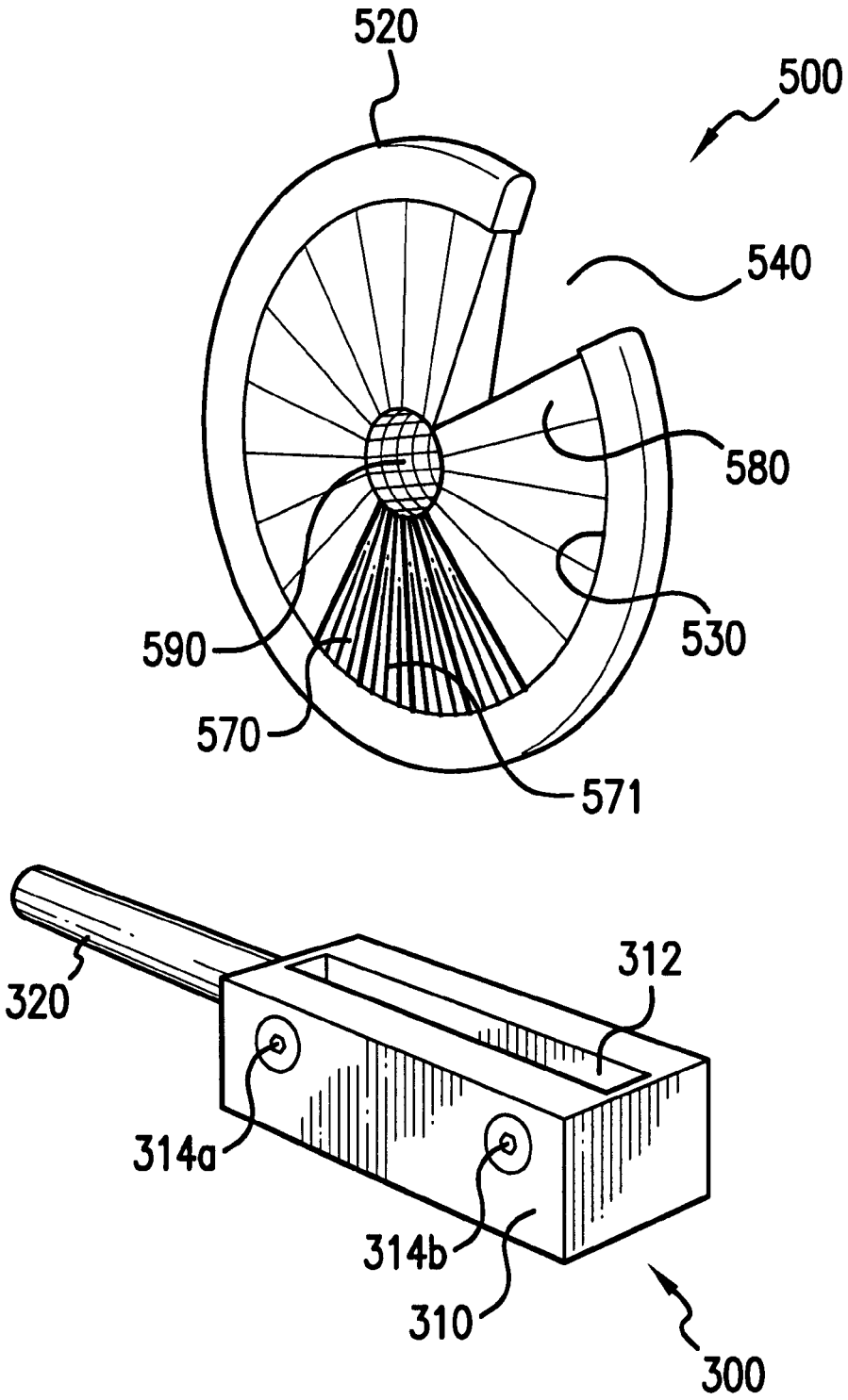
FIG. 5 is an exploded perspective view of an arrow rest frame and base member for a left-handed application according to an embodiment of the present invention.

Referring now to FIG. 5, an exploded perspective view of frame 500 and base member 300 is shown. Base member 300 includes a supporting member 310 and a linkage 320. The supporting member 310 and the linkage 320 are generally formed as a unitary whole. Alternatively, the supporting member 310 and the linkage 320 can be formed of separate components and coupled together. The supporting member 310 includes a trench 312 and orifices (not shown). The orifices are adapted to receive fastening elements 314*a*, 314*b*.

The trench 312 is adapted to receive a portion of frame 500. Preferably, the first supporting portion 571 is placed into trench 312 such that a center of aperture is substantially orthogonal to an axis disposed along the direction of the linkage 320. Alternatively, other suitable configurations of the frame 500 and the base member 300 can be used. The frame 500 is secured to the supporting member 310 by fastening elements 314*a*, 314*b*. Alternatively, frame 500 can be secured to the supporting member 310 by other suitable means, such as, for example, a friction fit.

Linkage 320 is coupled with the bow 100 by a fastening element (not shown). Any other suitable means of coupling the linkage 320 to the bow 100 can be used. The horizontal and vertical positioning of the frame 500 can be adjusted by making adjustments to the coupling of the linkage 320 with respect to the bow 100, for example, as shown in FIG. 1.

Figure 6:
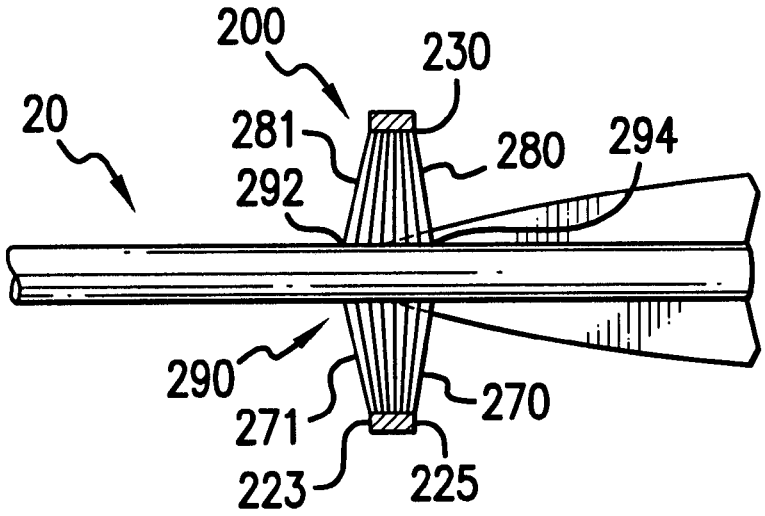
FIG. 6 is a cross-sectional view of an arrow disposed within the arrow rest frame of FIG. 2 in a ready-to-draw position.

Referring now to FIG. 6, a cross-sectional view of an arrow 20 disposed within the aperture 290 of frame 200 according to an embodiment of the present invention in a ready-to-draw position is shown. The arrow 20 is supported by first and second projections 270, 280. As shown in FIG. 6, the first projections 270 and the second projections 280 are approximately of equal length. Alternatively, the first projections 270 and the second projections 280 can be different lengths. Preferably, the length of the first and second projections 270, 280 measure approximately 0.500 inches in length. Alternatively, any other suitable length can be used.

Figure 7:
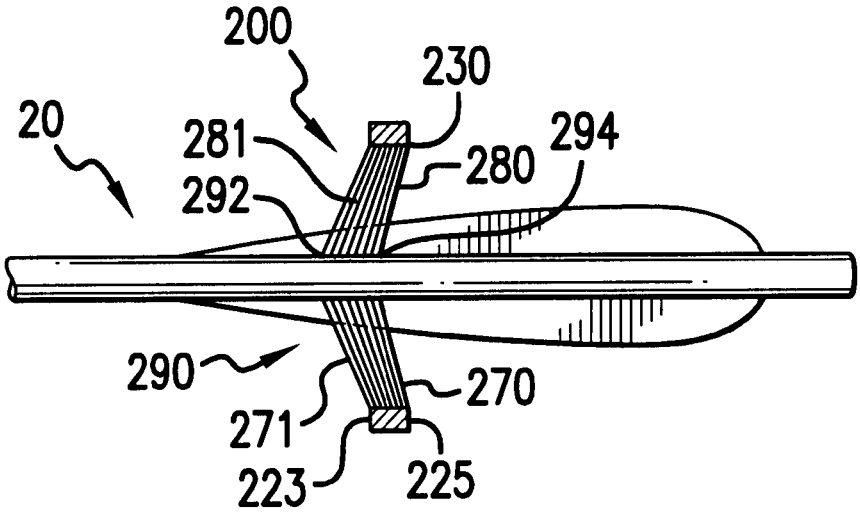
FIG. 7 is a cross-sectional view of an arrow disposed within the arrow rest frame of FIG. 2 as it is being projected through the arrow rest.

Referring now to FIG. 7, a cross-sectional view of arrow 20 disposed within the frame 200 according to an embodiment of the present invention as it is being projected through the frame 200 is shown. When arrow 20 is projected through the aperture 290, first and second projections 270, 280 are directed in a direction of travel of arrow 20, as shown in FIG. 7. After the arrow 20 is projected through the frame 200, first and second projections 270, 280 return back substantially to their original position as shown in FIG. 6.

Figure 8:
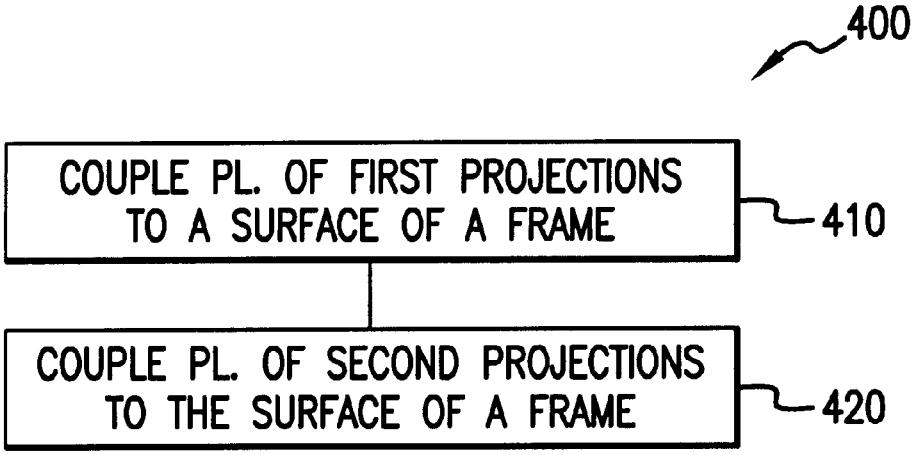
FIG. 8 is a block diagram of a method according to an embodiment of the present invention.

Referring now to FIG. 8, a method 400 according to an embodiment of the present invention is shown. The method 400 may be employed in the system 10 described above, and items shown in FIGS. 1–7 are referred to in describing FIG.

8 to aid understanding of the embodiment of the method 400 shown. However, embodiments of methods according to the present invention are not limited to the embodiments described above and shown in FIGS. 1–7, but may be employed in a wide variety of arrow rests and bow systems.

Referring to FIG. 8, block 410 indicates that a plurality of first projections is coupled to a surface of a frame. The frame can be similar to that described above with reference to FIGS. 1–7. Preferably, the frame is substantially circular. Alternatively, other suitable frames can be used. As described above, the frame includes first and second surfaces. The first projections are coupled to the second surface and extend radially inward.

The first projections include a first resistance. In one embodiment, the first resistance correlates with a first diameter of the first projections. Preferably, the first diameter is in a range as that described above. Alternatively, other suitable diameters can be used. In another embodiment, the first resistance correlates with a first density of the plurality of first projections. Preferably, the first density is in a range as that described above. Alternatively, other suitable densities can be used.

Block 420 shows that a plurality of second projections is coupled to the second surface of the frame and extends radially inward. The second projections include a second resistance. Preferably, the first resistance is greater than the second resistance. In one embodiment, the second resistance correlates with a second diameter of the second projections. Preferably, the second diameter is in a range as that described above. Preferably, the first diameter is greater than the second diameter. Alternatively, other suitable diameters can be used.

In another embodiment, the second resistance correlates with a second density of the plurality of second projections. Preferably, the second density is in a range as that described above. Preferably, the second density is greater than the first density. Alternatively, other suitable densities can be used.

The first and second projections define an aperture in which an arrow is supported. In one embodiment of the method 400, the first projections are disposed adjacent to the second projections. In another embodiment of the method 400, the first and second projections are coupled to a shaft. Preferably, the second surface of the frame is adapted to receive the shaft.

Figure 9:
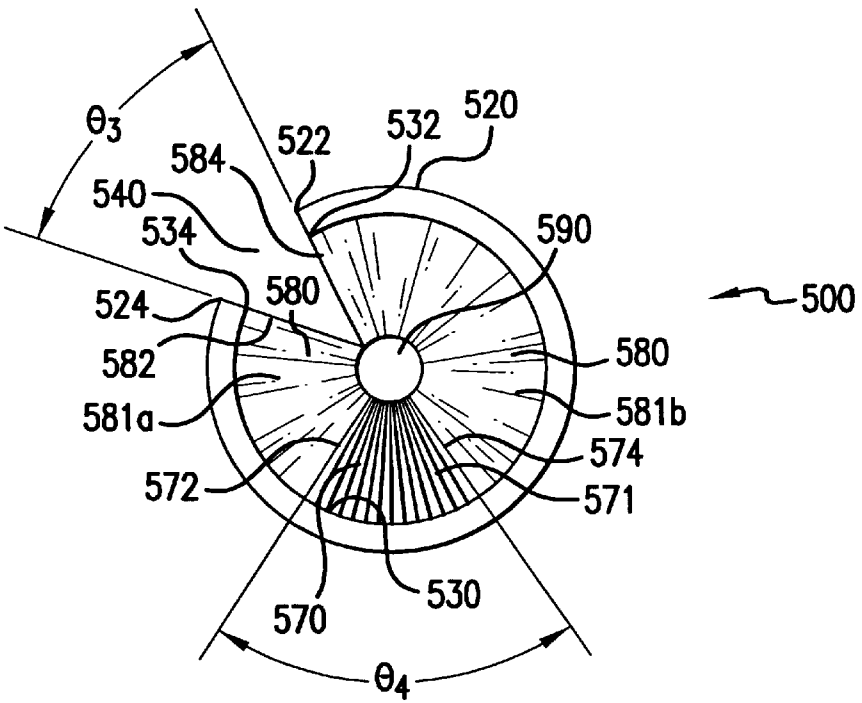
FIG. 9 is an elevation view of another embodiment of a frame of an arrow rest according to the present invention.

Referring now to FIG. 9, an alternate embodiment of an arrow rest frame 500 according to the present invention is shown. The frame 500 shown is suitable for either left or right-handed applications. As described above with reference to frame 200, the frame 500 includes first and second resistances and, thus, will not be repeated here.

Elements similar to the embodiments described above with reference to FIGS. 1–7 will not be repeated. Frame 500 includes a first surface 520 and a second surface 530. Preferably, the frame 500 is a substantially circular in shape. The first surface 520 forms an outer perimeter of the frame 500. The first surface 520 of the frame 500 includes a first end 522 and a second end 524. The second surface 530 of the frame 500 includes a first end 532 and a second end 534.

The first and second ends 522, 524 of the first surface 520 and first and second ends 532, 534 of the second surface 530 form a slot 540. An angle $\theta_3$ defines the slot 540. Preferably the angle $\theta_3$ defining the slot 540 is in a range between approximately 35 degrees and approximately 40 degrees. Preferably, the angle $\theta_3$ is approximately 37 degrees. As will be described in more detail below, slot 540 is of sufficient width to accommodate an arrow shaft.

Coupled to the second surface 530 are first projections 570. Preferably, the first projections 570 are formed of a plurality of bristles. Preferably, the first projections 570 extend from the second surface 530 radially inward. In one embodiment, the first projections 570 include a first side 572 and a second side 574. The first projections 570 are bounded by the first side 572 and the second side 574 forming a first supporting portion 571. An angle $\theta_4$ defines the first supporting portion 571. Preferably the angle $\theta_4$ is in a range between approximately 55 degrees and approximately 75 degrees. In one embodiment, the angle $\theta_4$ is approximately 58 degrees. In another embodiment, the angle $\theta_4$ is approximately 70 degrees.

Also coupled to the second surface 530 are second projections 580. The second projections 580 extend from the second surface 530. Preferably, the second projections 580 extend radially inward. In one embodiment, the second projections 580 include a first side 582 and a second side 584. The second projections 580 are bounded by the first side 582 of the second projections 580 and the first side 572 of the first projections 570 forming one second supporting portion 581*a*. The second projections 580 are also bounded by the second side 584 of the second projections 580 and the second side 574 of the first projections 570 forming another second supporting portion 581*b*.

Slot 540 is of sufficient width to accommodate a diameter of an arrow. Preferably, the width of slot 540 is approximately 0.546 inches. Alternatively, any other suitable width can be used. Arrow diameters generally vary and the preferred width of slot 540 is sufficient to accommodate most known arrows. Slot 540 can be disposed in positions in which loading an arrow into slot 540 does not interfere with other aspects of the bow 100. Determining which positions are suitable can also depend on the size of slot 540. A position deemed unsuitable using the preferred width described above may be made suitable by increasing the width of slot 540. The increased width of slot 540 would—when loading—allow an arrow to navigate around the interference or obstruction. Thus, the width and positioning of slot 540 can be varied to accommodate varying bow configurations.

As described above, the first projections 570 and the second projections 580 extend radially inward. The first projections and the second projections form an aperture 590. The aperture 590 is preferably a substantially circular shape. Preferably, a perimeter forming the aperture 590 includes a clearly visible opening, which facilitates insertion of an arrow into the frame 500. However, the opening is sufficiently continuous to prevent an arrow from escaping the frame 500 during normal movement or rotation of the bow 100.

The embodiments shown above include means for radially supporting an arrow relative to a bow. The supporting means shown includes the frame 200, 500 in combination with first projections 270, 570 and second projections 280, 580 as described above. Other supporting means may be used in other embodiments. For example, a frame having other shapes, such as, semicircular, rectangular, or other polygonal shapes, can be used. Also, projections other than bristles can be used, such as for example, natural fibers, pliable membranes, or solid surfaces. As described above, the first projections 270, 570 can include a unitary support, such as a "pie-shape," of sufficient strength to support an arrow and of sufficient durability to withstand repeated deflections. Other suitable structures can be used.

While the present invention has been disclosed with reference to certain embodiments, numerous modifications, alterations, and changes to the described embodiments are possible without departing from the sphere and scope of the present invention, as defined by the appended claims. Accordingly, it is intended that the present invention not be limited to the described embodiments, but that it has the full scope defined by the language of the following claims, and equivalents thereof.

What is claimed is:

1. An arrow rest for use with an archery bow, the arrow rest comprising:

a frame comprising a first surface and a second surface;

a plurality of first projections comprising a first resistance, the first projections extending from the second surface; and a plurality of second projections comprising a second resistance, the first resistance greater than the second resistance, the second projections extending from the second surface, the first and second projections defining an aperture, wherein an arrow may be radially supported.

2. The arrow rest of claim 1, wherein the frame comprises a generally disc-like shape.

3. The arrow rest of claim 1, wherein the second surface comprises an inner surface of the frame.

4. The arrow rest of claim 1, wherein the first and second projections are coupled to the second surface.

5. The arrow rest of claim 1, wherein the plurality of first projections comprise a first diameter and the plurality of second projections comprise a second diameter, the first resistance correlating with the first diameter and the second resistance correlating with the second diameter.

6. The arrow rest of claim 5, wherein the first diameter comprises a range between approximately 0.008 inches and 0.012 inches and the second diameter comprises a range between approximately 0.004 inches and approximately 0.010 inches.

7. The arrow rest of claim 1, wherein the plurality of first projections comprise a first density and the plurality of second projections comprise a second density, the first resistance correlating with the first density and the second resistance correlating with the second density.

8. The arrow rest of claim 7, wherein the first density comprises a range between approximately 9,000 projections per square inch and approximately 13,000 projections per square inch and the second density comprises a range between approximately 18,000 projections per square inch and approximately 26,000 projections per square inch.

9. The apparatus of claim 1, wherein the plurality of first projections is disposed along a segment of the second surface, the segment defined by an angle comprising a range between approximately 55 degrees and approximately 70 degrees.

10. The apparatus of claim 1, wherein the first and second projections extend radially.

11. The apparatus of claim 1, wherein the plurality of first projections is disposed adjacent to the plurality of second projections.

12. The apparatus of claim 1 further comprising a shaft, the plurality of first projections and the plurality of second projections coupled to the shaft, the second surface of the frame adapted to receive the shaft.

13. The apparatus of claim 1, wherein the first and second surfaces each comprise a first end and a second end, the first and second ends defining a slot.

14. A system comprising:

an archery bow;

a base member coupled to the bow; and an arrow rest coupled to the base member, the arrow rest comprising means for radially supporting an arrow relative to the bow, the supporting means comprising a first projection and a second projection, the first projection comprising a first resistance and the second projection comprising a second resistance, the first resistance being greater than the second resistance.

15. The system of claim 14, wherein the first projection comprises a first diameter and the second projection comprises a second diameter, the first resistance correlating with the first diameter and the second resistance correlating with the second diameter.

16. The system of claim 15, wherein the first diameter comprises a range between approximately 0.008 inches and 0.012 inches and the second diameter comprises a range between approximately 0.004 inches and approximately 0.010 inches.

17. The system of claim 14, wherein the first projection comprises a first density and the second projection comprises a second density, the first resistance correlating with the first density and the second resistance correlating with the second density.

18. The system of claim 17, wherein the first density comprises a range between approximately 9,000 projections per square inch and approximately 13,000 projections per square inch and the second density comprises a range between approximately 18,000 projections per square inch and approximately 26,000 projections per square inch.

19. The system of claim 14, wherein the first projection is disposed along a segment of the second surface, the segment defined by an angle comprising a range between approximately 55 degrees and approximately 70 degrees.

20. A method comprising:

coupling a plurality of first projections to a surface of a frame, the first projections extending from the surface and comprising a first resistance; and coupling a plurality of second projections to the surface, the second projections extending from the surface and comprising a second resistance, the first resistance greater than the second resistance, the first and second projections defining an aperture, the aperture adapted to radially support an arrow.

21. The method of claim 20, wherein the plurality of first projections comprises a first diameter and the plurality of second projections comprises a second diameter, the first resistance correlating with the first diameter and the second resistance correlating with the second diameter, the first diameter comprising a range between approximately 0.008 inches and 0.012 inches and the second diameter comprising a range between approximately 0.004 inches and approximately 0.010 inches.

22. The method of claim 20, wherein the plurality of first projections comprises a first density and the plurality of second projections comprises a second density, the first resistance correlating with the first density and the second resistance correlating with the second density, the first density comprising a range between approximately 9,000 projections per square inch and approximately 13,000 projections per square inch and the second density comprising a range between approximately 18,000 projections per square inch and approximately 26,000 projections per square inch.

23. The method of claim 20, further comprising coupling the first and second projections to a shaft, the surface of the frame adapted to receive the shaft.

24. The method of claim 20, further comprising disposing the plurality of first projections along a segment of the surface, the segment defined by an angle comprising a range between approximately 55 degrees and approximately 70 degrees.

25. The method of claim 24, further comprising disposing the plurality of first projections adjacent to the plurality of second projections.

* * * * *